US008540445B2

(12) United States Patent
Omoto

(10) Patent No.: US 8,540,445 B2
(45) Date of Patent: Sep. 24, 2013

(54) THREE DIMENSIONAL FACE MASK

(75) Inventor: Susumu Omoto, Sakai (JP)

(73) Assignee: Nichiei Co., Ltd., Osaka (JP)

( * ) Notice: Subject to any disclaimer, the term of this patent is extended or adjusted under 35 U.S.C. 154(b) by 518 days.

(21) Appl. No.: 12/421,720

(22) Filed: Apr. 10, 2009

(65) Prior Publication Data

US 2009/0255554 A1 Oct. 15, 2009

(30) Foreign Application Priority Data

Apr. 15, 2008 (JP) ..... 2008-105937
Aug. 19, 2008 (JP) ..... 2008-210497
Mar. 19, 2009 (JP) ..... 2009-067835

(51) Int. Cl.
*A42B 1/18* (2006.01)

(52) U.S. Cl.
USPC ..... 401/6; 401/9; 401/10; 401/11; 2/174; 2/206; 132/319

(58) Field of Classification Search
USPC ..... 132/319; 2/171.2, 173, 174, 206
See application file for complete search history.

(56) References Cited

U.S. PATENT DOCUMENTS 1,584,012 A 5/1926 Cocroft
3,674,593 A 7/1972 Pearson et al.
4,300,240 A * 11/1981 Edwards ..... 2/206
5,623,733 A 4/1997 Kurimoto et al.
8,387,163 B2 * 3/2013 Beliveau ..... 2/9
2003/0167556 A1 * 9/2003 Kelley ..... 2/206
2004/0022830 A1 2/2004 Nakamura et al.
2005/0048860 A1 3/2005 Ying et al.
2006/0048278 A1 * 3/2006 Pitsolis ..... 2/206
2009/0241242 A1 * 10/2009 Beatty et al. ..... 2/206
2010/0228204 A1 * 9/2010 Beatty et al. ..... 2/206
2011/0152795 A1 * 6/2011 Aledo et al. ..... 2/206
2012/0073030 A1 * 3/2012 Beatty et al. ..... 2/206

FOREIGN PATENT DOCUMENTS

DE 839404 5/1952
JP 03-014117 H 2/1991
JP 06-254477 H 9/1994
JP 07-000211 1/1995
JP 2001-245999 A 9/2001

(Continued)

OTHER PUBLICATIONS

European Search Report for corresponding application No. EP 09005397 dated Jul. 22, 2009.

*Primary Examiner* — Gregory Huson
*Assistant Examiner* — Bradley Oliver
(74) *Attorney, Agent, or Firm* — Renner, Otto, Boisselle & Sklar, LLP

(57) ABSTRACT

This face mask includes a right side sheet and a left side sheet which are mutually enantiomorphic. On a right side sheet and a left side sheet, a thermoplastic adhesive material is applied to the inner sides of ranges which include front edge strip portions which, during use, oppose the median line of the user's face; the right side sheet and the left side sheet are then laid together overlapping their inner sides; and heat is applied to areas of these front edge portions other than portions which, during use, oppose the nostrils and the mouth of the user, so that thereby the right side sheet and the left side sheet are joined together. By then opening out the right side sheet and the left side sheet in the direction to separate them, this face mask is caused to assume a three dimensional shape over its entire surface.

2 Claims, 10 Drawing Sheets

(56) References Cited

FOREIGN PATENT DOCUMENTS

| | | |
|---|---|---|
| JP | 2002-172022 | 6/2002 |
| JP | 2004-024626 | 1/2004 |
| JP | 2004-209143 A | 7/2004 |
| JP | 2006-025847 | 2/2006 |
| JP | 2006-025848 | 2/2006 |
| JP | 2007-330329 | 12/2007 |
| KR | 20-0400424 | 8/2005 |

* cited by examiner

THREE DIMENSIONAL FACE MASK

CROSS REFERENCE

This Nonprovisional application claims priority under 35 U.S.C. §119(a) on Patent Application No. 2008-105937, filed in Japan on Apr. 15, 2008, No. 2008-210497 filled in Japan on Aug. 19, 2008, and No. 2009-067835 filed in Japan on Mar. 19, 2009, the entire contents of which are hereby incorporated by reference.

BACKGROUND OF THE INVENTION

From the past, as described in Japanese Laid-Open Patent Publication 2002-172022, a face mask, which is a sheet material for cosmetic use, has been used as a beauty accessory, and is used when supplying a liquid such as a liquid foundation or the like to the skin of a user's face.

Such a face mask is built from a single sheet of material and includes portions which oppose the user's eyes, a portion which opposes her nose, and a notch or hole portion at a portion which opposes her mouth, and is impregnated with a liquid such as a liquid cosmetic or the like and then is mounted upon the user's face.

However, when such prior art face mask which is built from a single sheet of material is mounted upon the entire face of the user which has a three-dimensional concavo-convex shape, wrinkling or slack is partially created, thereby causing that the face mask cannot be uniformly applied to the entire face of the user. Due to this, the problem has arisen that the face mask cannot be uniformly applied (with the use of a liquid cosmetic or the like) to the entire face of the user.

There is another type of a face mask around which incisions are made. In such a type of the face mask, however, there have been the problems that the user, during use, have to pinch between fingers each of portions of the face mask between incisions which are made around the face mask, and apply it to the face of the user, and that the adherence around a center portion of the user's face cannot be improved.

Furthermore, since a lower point of the prior art face mask is only mounted upon portions from the lower surface of the user's chin to the upper portion of the user's neck, there has been the problem that the face mask easily peels off when the user shakes her head.

A three dimensional face mask of the present invention comprises a left side sheet and a right side sheet which respectively, during use, oppose the left side and the right side of the face of a user, and which have front edge portions which, during use, oppose a median line of the face of the user, wherein the front edge portions present shapes which, overall, are convex to the outside. An object of the present invention is to provide the three dimensional face mask and a method of manufacture thereof, wherein the left side sheet and the right side sheet are joined together at the front edge portions, thereby ensuring that the three dimensional face mask which is reliably applied to the face of the user which has a concavo-convex shape is achieved in a simple configuration, and that the face mask is easily applied to the entire face of the user including a chin over its entire surface.

SUMMARY OF THE INVENTION

The three dimensional face mask according to the present invention includes a left side sheet and a right side sheet. The left side sheet and the right side sheet have planar shapes, and, during use, respectively oppose the left side and the right side of the face of a user; and their front edge portions have enantiomorphic shapes which, during use, oppose the median line of the face of the user. These front edge portions have shapes which, as a whole, are convex to the exterior. The left side sheet and the right side sheet are provided with an adhesive material all over them, or on at least on inner surface portions, in the thickness direction, of portions which include areas towards their said front edge portions from lines which connect from their upper points to their chin portions which, during use, oppose the chin of the user. And the left side sheet and the right side sheet are thereby adhered together over a range of a certain width, except for a portion which, during use, opposes the nostrils of the user, and a portion which, during use, opposes the mouth of the user.

DETAILED DESCRIPTION OF THE INVENTION

Figure 1:
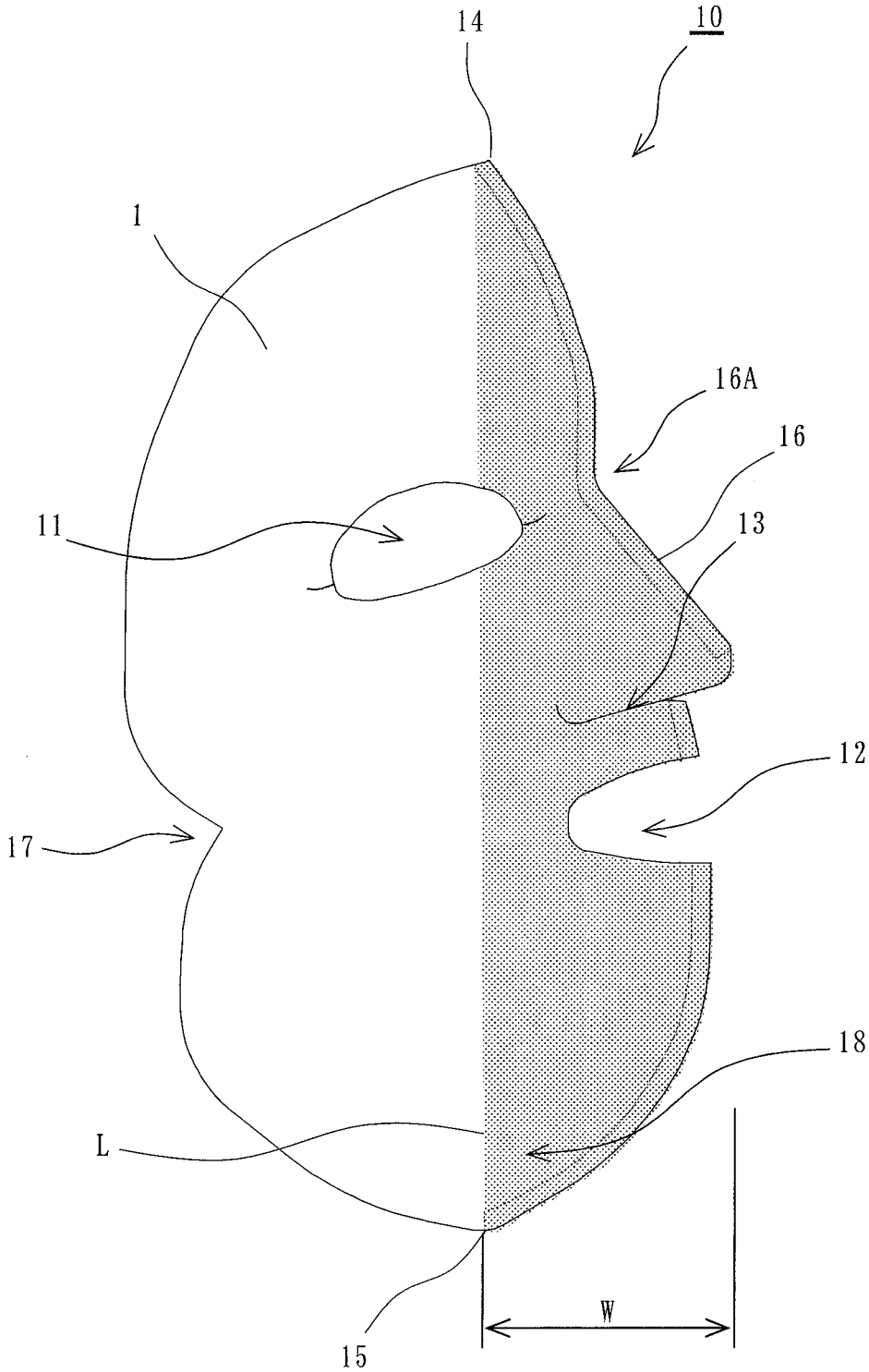
FIG. 1 is a plan view of a three dimensional face mask according to a first embodiment of the present invention.

As shown in FIG. 1, the three dimensional face mask 10 according to the first embodiment of this invention is made by a process of punching out from a sheet material, which for example may be a non-woven fabric raw material, a right side sheet 1 which is to oppose the right side of the user's face and a left side sheet 2 which is to oppose the left side of her face, superimposing these two sheets in the state in which their inner edges are mutually overlapped, and then adhering them together. (It should be noted that, in this specification, "right" and "left" are used as referring to the point of view of the user.) The right side sheet 1 and the left side sheet 2 have shapes which are enantiomorphic. FIG. 1 is a plan view as seen from the side of the right side sheet 1, and accordingly the left side sheet 2 is not visible in this figure, because it lies under the right side sheet 1.

A hole portion 11, a concave portion 12, and a cut 13 are formed in the right side sheet 1. The hole portion 11 is disposed so that it will oppose the right eye of the user. The concave portion 12 is disposed so that it will oppose the right side of the lips of the user. And the cut 13 is disposed so that it will oppose the right nostril of the user. This right side sheet 1 presents a shape such that an upper point 14 thereof projects upwards while a lower point 15 thereof projects downwards. Upon this right side sheet 1, there is provided a thermoplastic adhesive material on the inner side of a portion of width W which is more towards the front edge portion 16 which, during use, lies over the median line of the user's face than a line drawn from the upper point 14 toward a chin portion 18. This adhesive material may, for example, be a thermoplastic resin powder. A cutaway 17 is formed at an intermediate portion of the left side edge portion of the right side sheet 1 in the figure, i.e. of its rear edge portion at its opposite side from its front edge portion 16. The shape of the left side sheet 2 is similar to that of the right side sheet 1, but is enantiomorphic thereto.

The two ends of a line L drawn from the upper point 14 toward the chin portion 18 which, during use, opposes a chin of the user coincide with the upper point 14 and the lower point 15 of a strip along the front edge portion 16.

The front edge portion of the right side sheet 1, as a whole, has a shape which is made up of a plurality of circular arcs, and which is convex to the outside. As shown by the broken line in FIG. 1, this front edge portion 16 is joined to the left side sheet 2 from the upper point 14 to the lower point 15, except for a portion of a certain width which opposes the nostril aperture, and for the concave portion 112.

It should be understood that the mid-eyebrow portion 16A of the front edge portion 16 which faces the space between the user's eyebrows (just above her nose) is formed as a circular arc which is convex to the inside, and by opening out the edges of the right side sheet 1 and the left side sheet 2, in the direction to separate them, the three dimensional face mask 10 presents a three dimensional shape. Due to this, it is possible to keep this three dimensional face mask 10 reliably contacted against the central portion of the user's face which includes its median line.

Furthermore, since the front edge portions 16 of the right side sheet 1 and the left side sheet 2 are adhered together all the way to the lower point 15 which projects downward, accordingly, when this three dimensional face mask 10 has been applied to the face of the user, the shape of the front edge portion 16 is maintained in the state in which it is contacted from the lower surface of her chin all the way to the upper portion of her head. Due to this, the three dimensional face mask 10 is reliably held against the entire face of the user over its whole surface, and it is possible to prevent the lower portion of the three dimensional face mask 10 from separating from the user's chin when she moves her head to the left or the right.

Since this three dimensional face mask 10 has a surface which is curved in three dimensions, accordingly it is possible for it to be reliably applied to the face of the user over its entire surface, without any necessity for notches to be formed upon the periphery of the mask; but, in order further to enhance the adherence, instead of or as well as the cutaways 17, it would also be acceptable to form other notches or the like on the border portions of the right side sheet 1 and the left side sheet 2, over some range other than their front edge portions 16.

Figure 2:
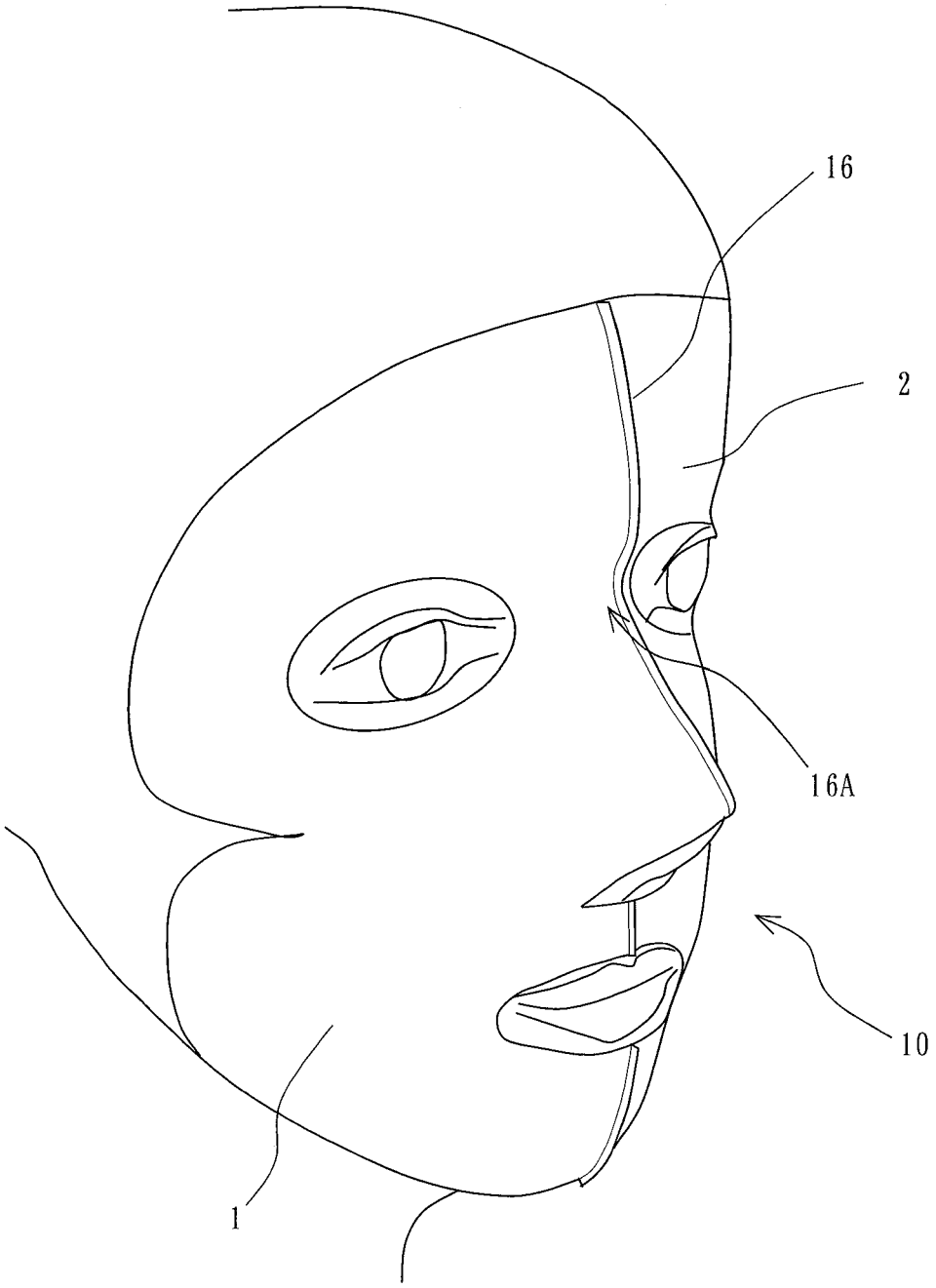
FIG. 2 is a figure showing the state during use of this three dimensional face mask according to the first embodiment of the present invention.

As shown in FIG. 2, when this three dimensional face mask 10 is to be used, and when it is opened up in the direction to mutually separate the border portions of the right side sheet 1 and the left side sheet 2 from one another over their range other than their front edge portions 16, then the three dimensional face mask 10 assumes a three dimensional shape which, as a whole, is convex to the exterior.

Due to this, the three dimensional face mask 10 can be uniformly applied (with the use of a liquid cosmetic) to the entire face of the user which has a three-dimensional concavo-convex shape, without any wrinkling or slack being created. In particular since, according to the present invention, the mid-eyebrow portion 16A of the mask 10 can be made as a circular arc which is convex inwards, accordingly it is possible for the front edge portion 16 to follow closely the median line of the user's face. Due to this, it is possible to ensure that the advantageous effect of the liquid cosmetic such as a liquid foundation or the like, with which this three dimensional face mask 10 is impregnated in advance, is obtained over the entire face of the user.

Moreover, before use, this three dimensional face mask 10 assumes a planar shape, due to the right side sheet 1 and the left side sheet 2 being mutually superimposed so that their inner surfaces contact one another. Due to this, even if a plurality of these three dimensional face masks 10 are laid over one another by themselves, or even if a plurality of packages, in each of which one of these three dimensional face masks 10 is stored, are laid over one another, still a lot of space is not occupied; so that handling during factory production and during distribution, sale, and purchase becomes very easy.

Figure 3A:
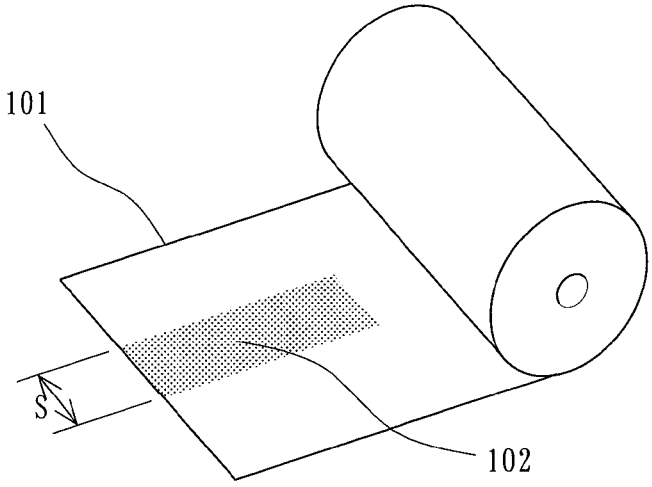
FIGS. 3A through 3D are figures showing a process for manufacturing this three dimensional face mask according to the first embodiment of the present invention.

An example of a process for manufacturing the three dimensional face mask described above will now be described with reference to FIGS. 3A through 3D. When the three dimensional face mask 10 is to be manufactured, first, as shown in FIG. 3(A), a sheet 101 which is to be the raw material for this three dimensional face mask 10 is pulled out from a roll, and then a thermoplastic adhesive material 102 is applied over a certain width S upon a portion of that surface which is to constitute the inner side of the three dimensional face mask 10, this portion being central on the surface in the direction orthogonal to the direction in which the pulling out of the sheet 101 was performed. This certain width S when applying the adhesive material is set to be slightly greater than twice the width W shown in FIG. 1.

Subsequently it is also acceptable, by applying heat to the sheet 101 over a certain time period, to melt the adhesive material 102 temporarily and thus to cause it to adhere to the sheet 101. By doing this it is possible to prevent the adhesive material 102 from separating from the three dimensional face mask 10 during transportation or during use, in particular if the adhesive material 102 is a powder.

Figure 3B:
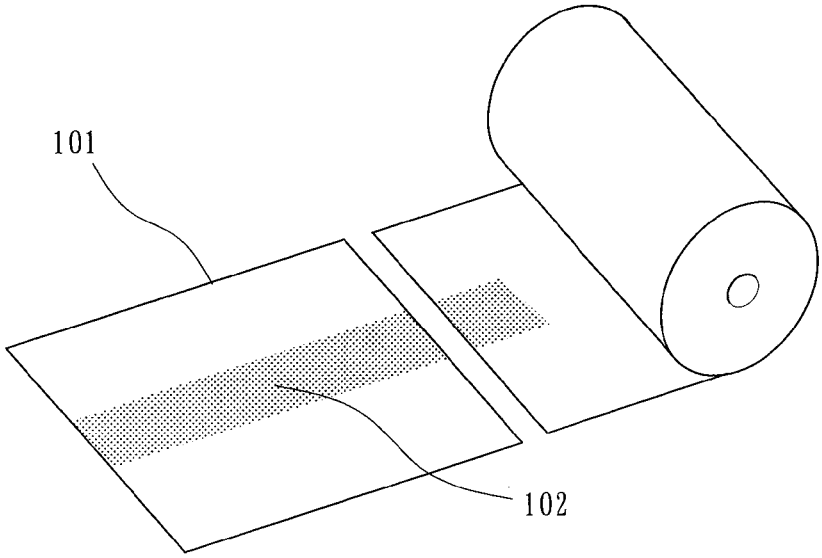

Next, as shown in FIG. 3B, the sheet 101 is cut off to a certain length along the direction in which it was pulled out, longer than the length in the vertical direction of the three dimensional face mask 10 which is to be made.

Figure 3C:
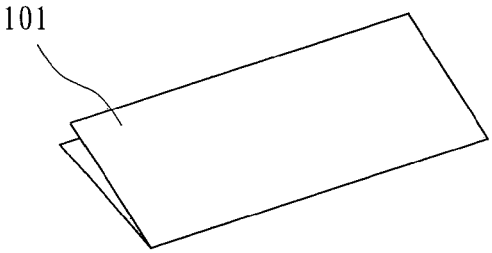

Then, as shown in FIG. 3C, the sheet 101 which has thus been cut off is folded over along its center line which is parallel to the direction in which it was pulled out, so that it is doubled over itself into two mutually superimposed layers.

Figure 3D:
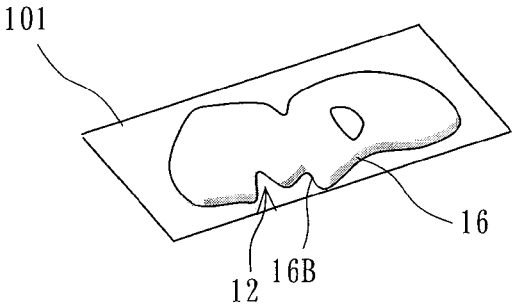

Finally, as shown in FIG. 3D, as an example, the shape of the right side sheet 1 of the mask 10 is punched out from this sheet 101 which has thus been folded over and doubled into two superimposed layers, thus also punching out, at the same time, the enantiomorphic shape of the left side sheet 2 underneath the right side sheet 1. At this time, heat is applied to the front edge portion 16 of the resulting cut out mask 10 over a band of a certain width, except for the nose hole portion 16B which opposes the nostril hole and the concave portion 12, so that the two layers of the mask 10 are adhered together over this front edge portion 16. This application of heat may, for example, be performed with an ultrasonic vibrator which emits ultrasonic vibrations.

Due to this, it is possible to adhere together the right side sheet 1, which is currently on the top, and the left side sheet 2, which is currently underneath, along their front edge portions 16, with the exception of their nose hole portions 16B and the concave mouth portions 12, and thereby the three dimensional face mask 10 having the shape shown in FIG. 1 is obtained.

It should be understood that it would also be acceptable to perform the adhesion process for the front edge portions 16, before performing the punching out process. In this case, the shape of the right side sheet 1 should be punched out of the folded over sheet 101 after having, for example, performed application of heat using a heat application member which is divided into two portions, one of which reaches from the upper tip portion 14 of the mask 10 to the portion which opposes the lower point of the nose, and the other of which reaches from a portion which opposes a point between the nose and the upper lip to the lower end portion of the chin portion 15. By doing this, it is possible to match the positions on the sheet 101 of the portions to which heat should be applied and to the portions which are to be punched out in a simple and easy manner.

Furthermore, by using a sheet which carries the adhesive material 102 over its entire surface, i.e. from one side to the other in the thickness direction, it would also be possible to omit the process of application of the adhesive material 102, and moreover the process of heat application to the sheet 101 as a whole. It is not necessary for the adhesive material 102 to be a powder; it would also be possible to adhere an adhesive material 102 to the upper surface of the sheet 101 in the form of a film. Yet further, it would also be acceptable to arrange to omit the cutting process of FIG. 3B.

In concrete terms, for the sheet 101, there may be used a non-woven fabric or woven fabric which consists of natural fibers with an admixture of thermoplastic fibers which constitute an adhesive material, or a non-woven fabric or woven fabric which only consists of such thermoplastic fibers which constitute an adhesive material. Furthermore, as the sheet 101, it would also be acceptable to use a sheet consisting of a non-woven fabric or a woven fabric made from natural fibers, to one surface of which a thermoplastic powder which is an adhesive material has been applied, and which has then been subjected to heat application processing, or a sheet consisting of a non-woven fabric or a woven fabric made from natural fibers, to one surface of which a thermoplastic film which is an adhesive material has been adhered, and which has then been subjected to heat application processing.

By doing as described above, it is possible to omit the process of application or adhesion of the adhesive material, and thus it is possible to implement a reduction in cost due to the omission of that working process.

Moreover, as shown in FIG. 1, by applying the adhesive material 102 only to the outside of the line which joins the upper and lower end portions of the front edge portion 16 along with the right side sheet 1 and the left side sheet 2 are to be adhered together, it is possible to reduce the range upon the sheet 101 over which the adhesive material 102 is applied. And, by making the shape of the application member match the shape of the portions which are to be joined together, and by thus arranging to apply the adhesive material 102 only to the range over which adherence is to be provided which the application member contacts, it would also be possible to reduce the range of application of the adhesive material 102 to the minimum.

It should be understood that the adhesive material 102 is not limited to being a material which is thermoplastic; it would also be possible to utilize a material which can be pressurized for adhering together the right side sheet 1 and the left side sheet 2, or a material which is hardened optically.

Figure 4A:
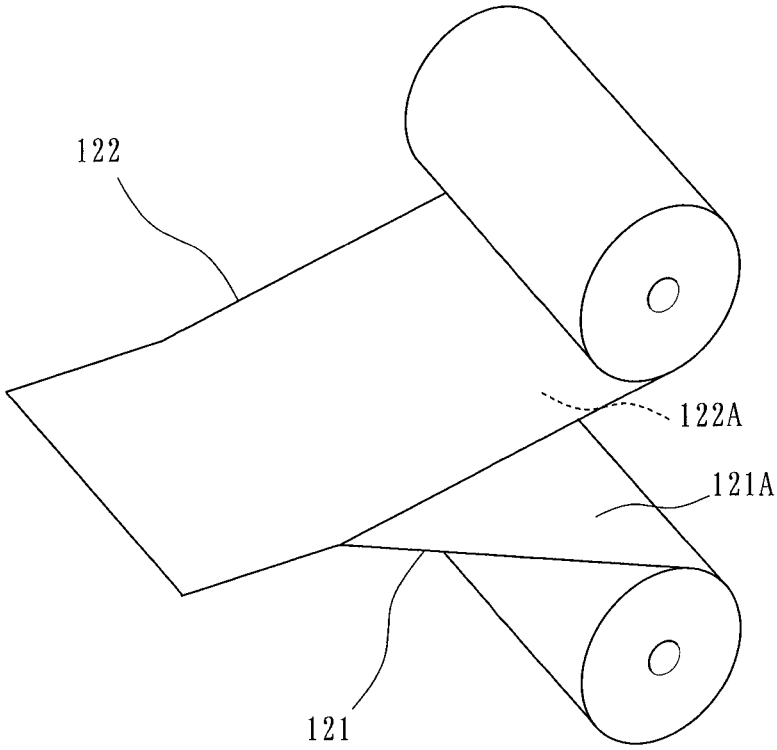
FIGS. 4A and 4B are figures showing another process for manufacturing this three dimensional face mask according to the first embodiment of the present invention.
Figure 4B:
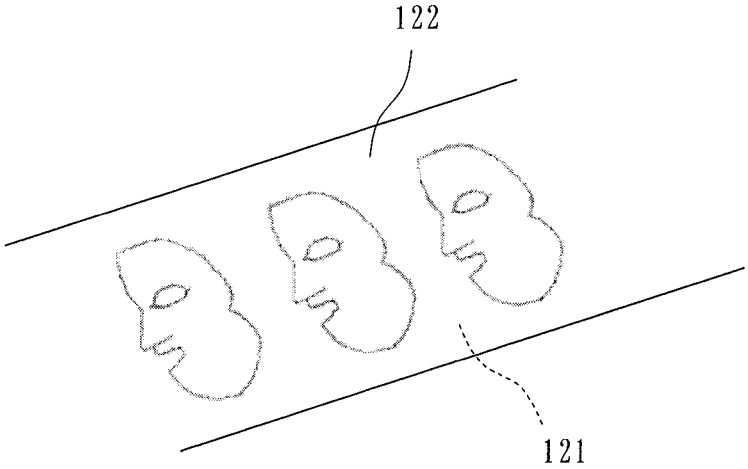

Finally, as shown in FIG. 4, it would also be possible to pull out and mutually superimpose each of a sheet 121 for making the right side sheet 1 and a sheet 122 for making the left side sheet 2 from a different roll. The surface 121A of the sheet 121 and the surface 122A of the sheet 122 are covered with adhesive material 123 over their entire widths. As shown in FIG. 4A, the sheets 121 and 122 are then mutually superimposed in the state in which their respective surfaces 121A and 122A contact one another. Subsequently, as shown in FIG. 4B, for example, the shape of the left side sheet 2 is punched out from the superimposed sheets 121 and 122, while applying heat to a strip of a certain width along its front edge portion, except for the nose hole portion 16B and the concave portion 12, for example by using an ultrasonic vibrator.

Figure 5:
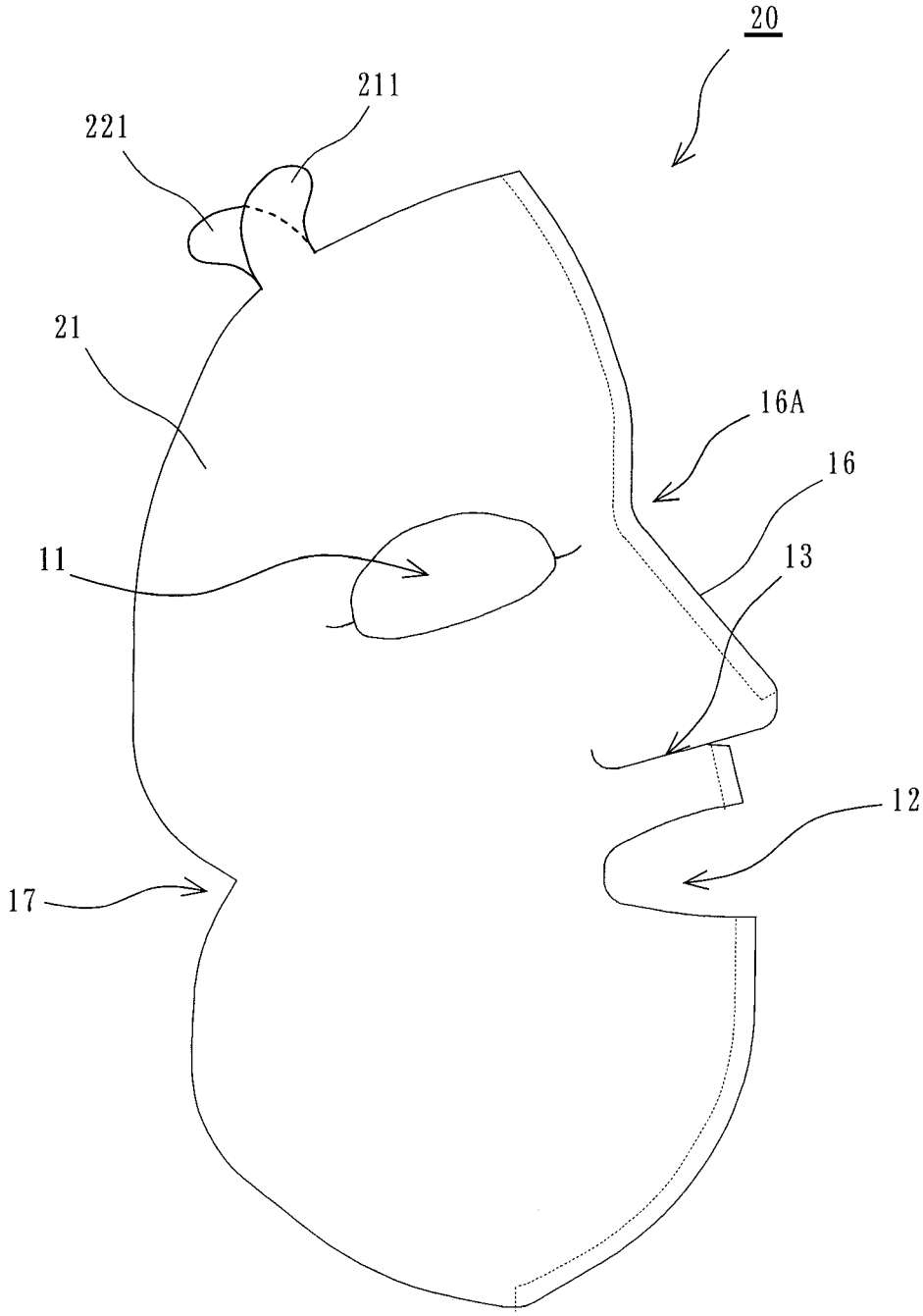
FIG. 5 is a plan view of a three dimensional face mask according to a second embodiment of the present invention.

As shown in FIG. 5, with a three dimensional face mask 110 according to a second embodiment of the present invention, there are additionally formed two projecting tabs 211 and 221 at upper portions of the right side sheet 21 and the left side sheet 22 which, in use, oppose the forehead of the user (the left side sheet 22 does not appear in the figure). The other aspects of the structure of this second embodiment are the same as in the case of the three dimensional face mask 10 of the first embodiment, described above.

With this three dimensional face mask 20, although, in the state in which the inner surfaces of the right side sheet 21 and the left side sheet 22 are superimposed and mutually contact one another, the base portion of the tab 211 (the position upon the left side sheet 21 where it protrudes) and the base portion of the tab 221 (the position upon the right side sheet 22 where it protrudes) are mutually superimposed, the upper portion of the tab 211 from an intermediate portion thereof and the upper portion of the tab 221 from an intermediate portion thereof are not mutually superimposed, but rather curl around in opposite directions. Accordingly, the tab 211 and the tab 221 are not symmetric with respect to the front edge portion 16 which, during use, opposes the median line of the face of the user.

When the front edge portion 16 of this three dimensional face mask 20 is folded into two, since in this state it is possible to distinguish the tab 211 and the tab 221 from one another, accordingly it is possible easily to pinch the tab 211 and the tab 221 with the fingers of the left hand and of the right hand respectively, and then easily to pull apart the left side sheet 21 and the right side sheet 22 of the three dimensional face mask 20 to the left and right. And, when using this three dimensional face mask 20 which is in the state in which the left side sheet 21 and the right side sheet 22 are still mutually superimposed or are even further folded up, or when the mask 20 is in the state of being rolled up, the task of separating the left side sheet 21 and the right side sheet 22 to the left and right respectively can be performed simply and easily when the three dimensional face mask 20 has been impregnated with liquid foundation or the like.

A method of manufacturing this three dimensional face mask 20 according to the second embodiment of the present invention will now be explained in the following with reference to FIGS. 6A through 6C. In this method of manufacture, a sheet 111 is used which is loaded in advance with a thermoplastic adhesive material over at least its entire upper surface.

Figure 6A:
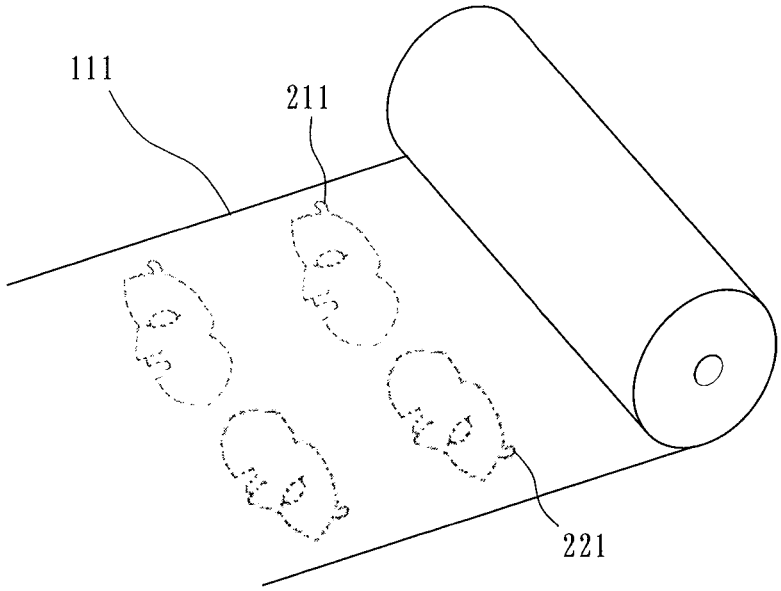
FIGS. 6A through 6C are figures showing a process for manufacturing this three dimensional face mask according to the second embodiment of the present invention.

First, as shown in FIG. 6A, a sheet 111 is pulled out from a roll, and tabs 211 and tabs 221 are cut out. This cutting out of the tabs 211 and 221 is performed before folding the sheet 111 into two, since the shapes of the tabs 211 and 221 are not symmetrical between left and right. In FIG. 6A, a case is shown in which the right side sheets 21 and the left side sheets 22 which make up the three dimensional face masks 20 are formed so that their vertical directions extend in the direction which is orthogonal to the direction in which the sheet 111 is pulled out.

Figure 6B:
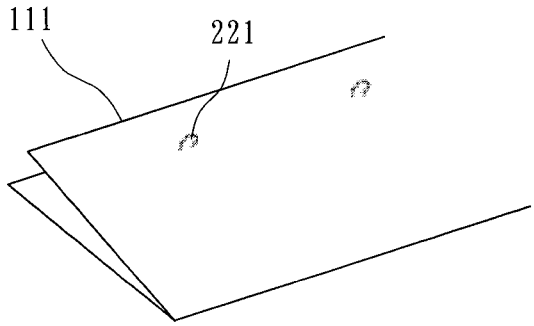

Next, as shown in FIG. 6B, the sheet 111 is folded over into two along its center line, which is parallel to the direction in which it was pulled out.

Figure 6C:
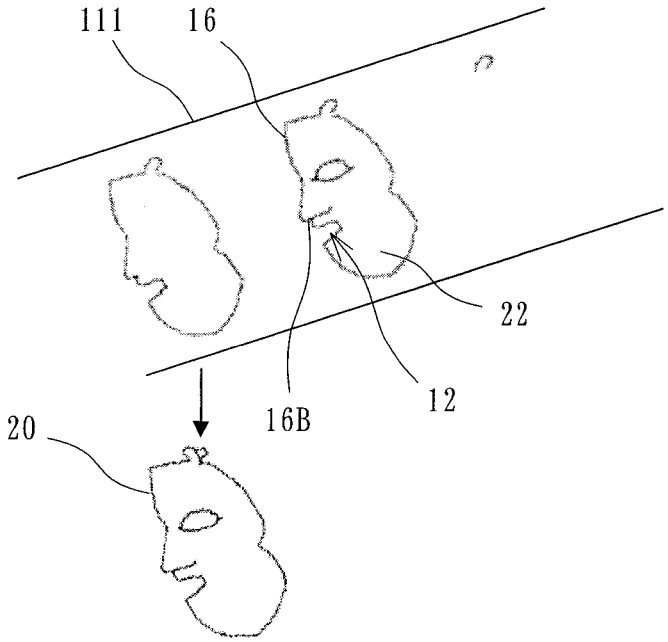

Then, as shown in FIG. 6C, the shape of the left side sheet 22 (for example) is punched out of the sheet 111 which has thus been folded over and doubled. At this time, the position in the shape of this left side sheet 22 at which the tab 221 protrudes matches the two ends of the line upon the sheet 111 at which the tab 221 has already been cut out. Moreover, the position in the shape of the right side sheet 21 (which is underneath, and which is cut out at the same time) at which the tab 211 protrudes also matches the two ends of the line upon the sheet 111 at which the tab 211 has already been cut out. Simultaneously with this, heat is applied along the superimposed front edge portions of the right side sheet 21 and the left side sheet 22 over a certain width along these edges, with the exception of their nostril hole portions 16B and their concave mouth portions 12, so that they are adhered together. This application of heat may, for example, be performed by ultrasound oscillation with an ultrasound vibrator.

Due to this, the left side sheet 22 (which is on top) and the right side sheet 21 (which is underneath) are adhered together along their front edge portions 16 by the adhesive material which is contained in the sheet 111, with the exception of their nostril hole portions 16B and their concave mouth portions 12, so that the three dimensional face mask 20 may be obtained. The right side sheet 21 does not appear in FIG. 6C.

It should be understood that the adhesive material 102 is not limited to being a material which is thermoplastic; just as in the case of the three dimensional face mask 10 of the first embodiment, it would also be possible to utilize a material which can be pressurized so as to adhere together the right side sheet 1 and the left side sheet 2 along their front edge portions 16, or a material which is hardened optically.

With this three dimensional face mask 20, just as was the case for the three dimensional face mask 10 of the first embodiment, it is also possible to pull out the sheet for the right side sheet 21 and the sheet for the left side sheet 22 from separate rolls, and then to lay them over one another. In this case, the respective tabs 211 and 221 should be formed before superimposing the sheet for the right side sheet 21 and the sheet for the left side sheet 22.

Furthermore, although both the three dimensional face mask 10 and the three dimensional face mask 20 were made so as to have uniform thickness over their entire surfaces, it would also be acceptable to arrange to increase their thicknesses so as to increase the amount of liquid foundation or the like which is held in them, for example by adhering sheets which are separate from the sheet 101 or the sheet 111 to portions which, during use, oppose the edges of the user's eyes, or the like. In this case, for example, during the process shown in FIGS. 6A through 6C, before punching out the tabs 211 and 221 in the process of FIG. 6A, or before the process of FIG. 6B after having punched out the tabs 211 and 221, these other sheets of a certain width should be adhered in positions which during use, for example, oppose the user's eyes, along the direction in which the sheet 11 is pulled out. This adhesion may be performed, for example, by applying heat to an adhesive material which is thermoplastic, or by applying an adhesive.

Figure 7:
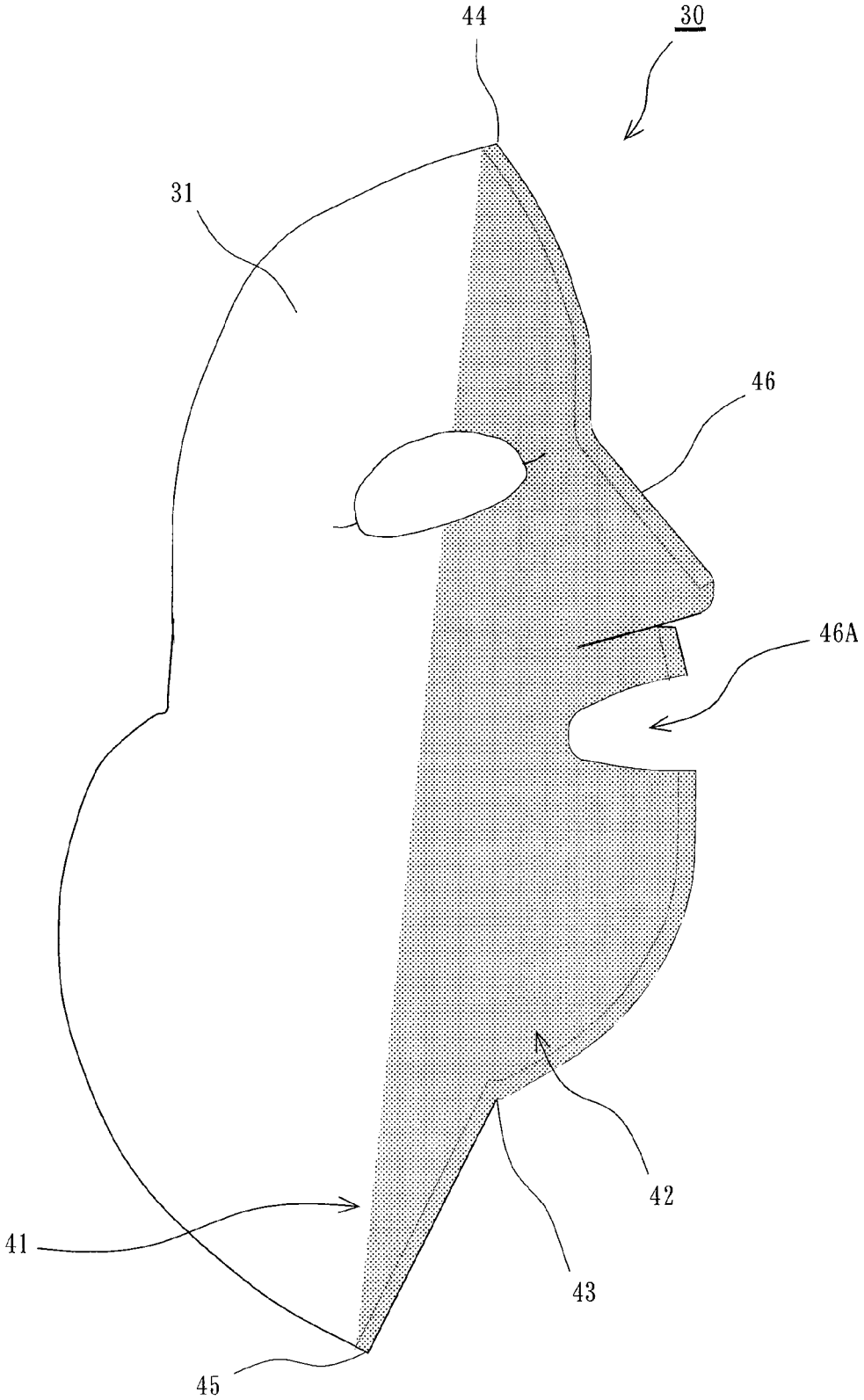
FIG. 7 is a plan view of a three dimensional face mask according to a third embodiment of the present invention.

As shown in FIG. 7, in a three dimensional face mask 30 according to a third embodiment of the present invention, the right side sheet 31 and the left side sheet 32 (the left side sheet 32 does not appear in FIG. 7) are formed with neck portions 41 which, during use, oppose the lower surface of the chin and the neck of the user, and which are formed from below the user's ears to an intermediate portion of the user's throat. Accordingly, on the front edge portion 46, this neck portion 41 protrudes so as, during use, to face the portions of the user's face, from the lower end portion 43 of the chin portion 42 which faces the user's chin downwards until that intermediate portion of the user's throat. The other aspects of the structure of this third embodiment are the same as in the case of the three dimensional face mask 10 of the first embodiment, described above.

The front edge portion 46 of the right side sheet 31, as a whole, exhibits a shape which is convex to the outside, and is made up of a plurality of circular arcs. As shown by the broken line in FIG. 7, this front edge portion 46 is joined to the left side sheet 42 from its upper point 44 to its lower point 45 along a track of a certain width, with the exception of the portion which, during use, opposes the lower surface of the user's nose (i.e. her nostrils), and the concave portion 46A which opposes the user's mouth.

Figure 8:
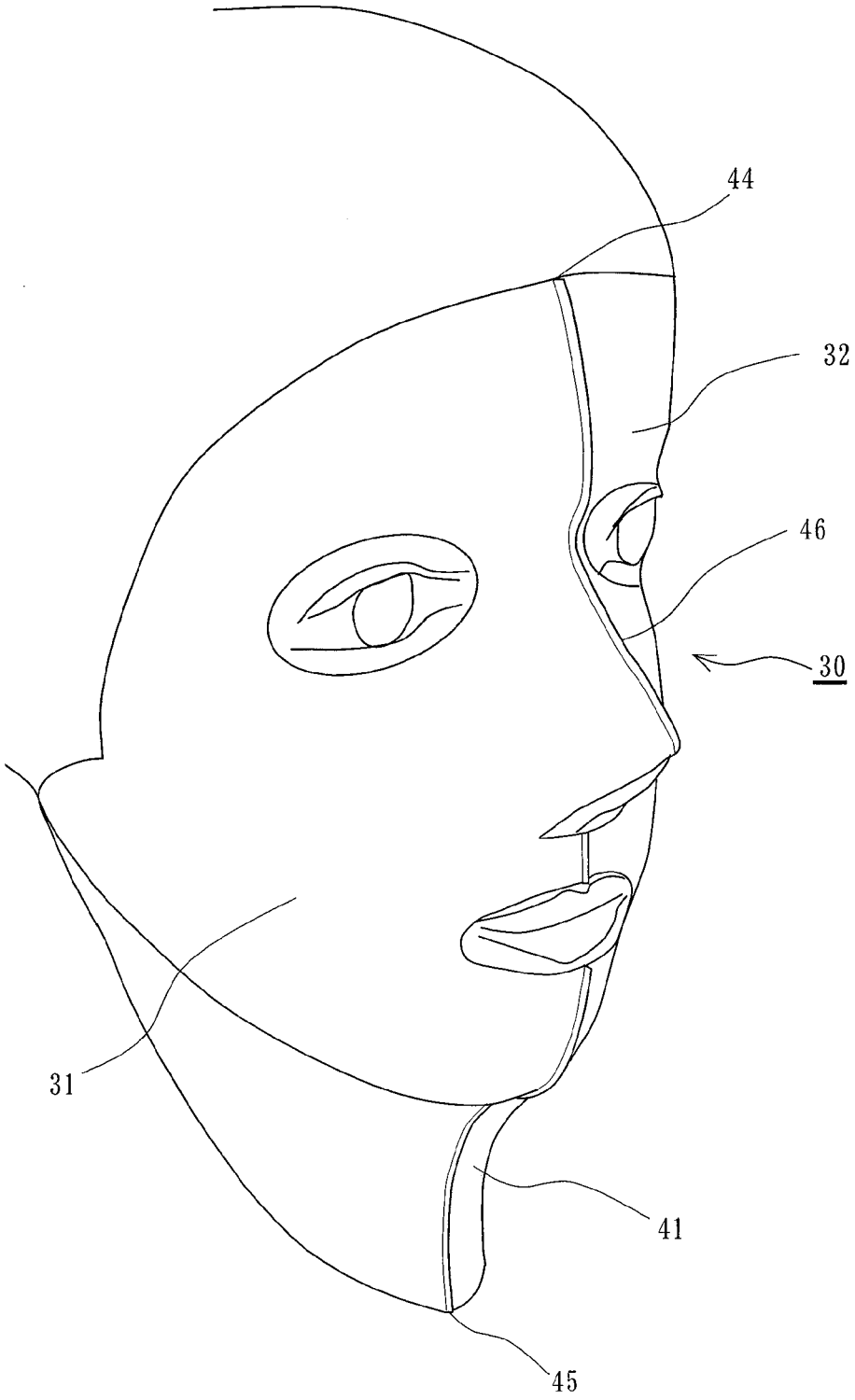
FIG. 8 is a figure showing the state of this three dimensional face mask according to the third embodiment of the present invention during use.

The front edge portions 46 of the right side sheet 41 and the left side sheet 42 are mutually adhered together until their lower points 45 which project downward. When this three dimensional face mask 30 is stuck to the face of the user, as shown in FIG. 8, the shape of this edge portion 46 is maintained in the state in which, from its upper point 44 to its lower point 45, the mask 30 is contacted against the user's face from her forehead through the lower surface of her chin all the way to the intermediate portion of her throat. Due to this, this three dimensional face mask 30 is reliably kept closely against the entire surface of the user's face, and, when the user moves her head to the left or the right, it is possible reliably to prevent the lower portion of this three dimensional face mask 30 from separating from her chin.

Figure 9:
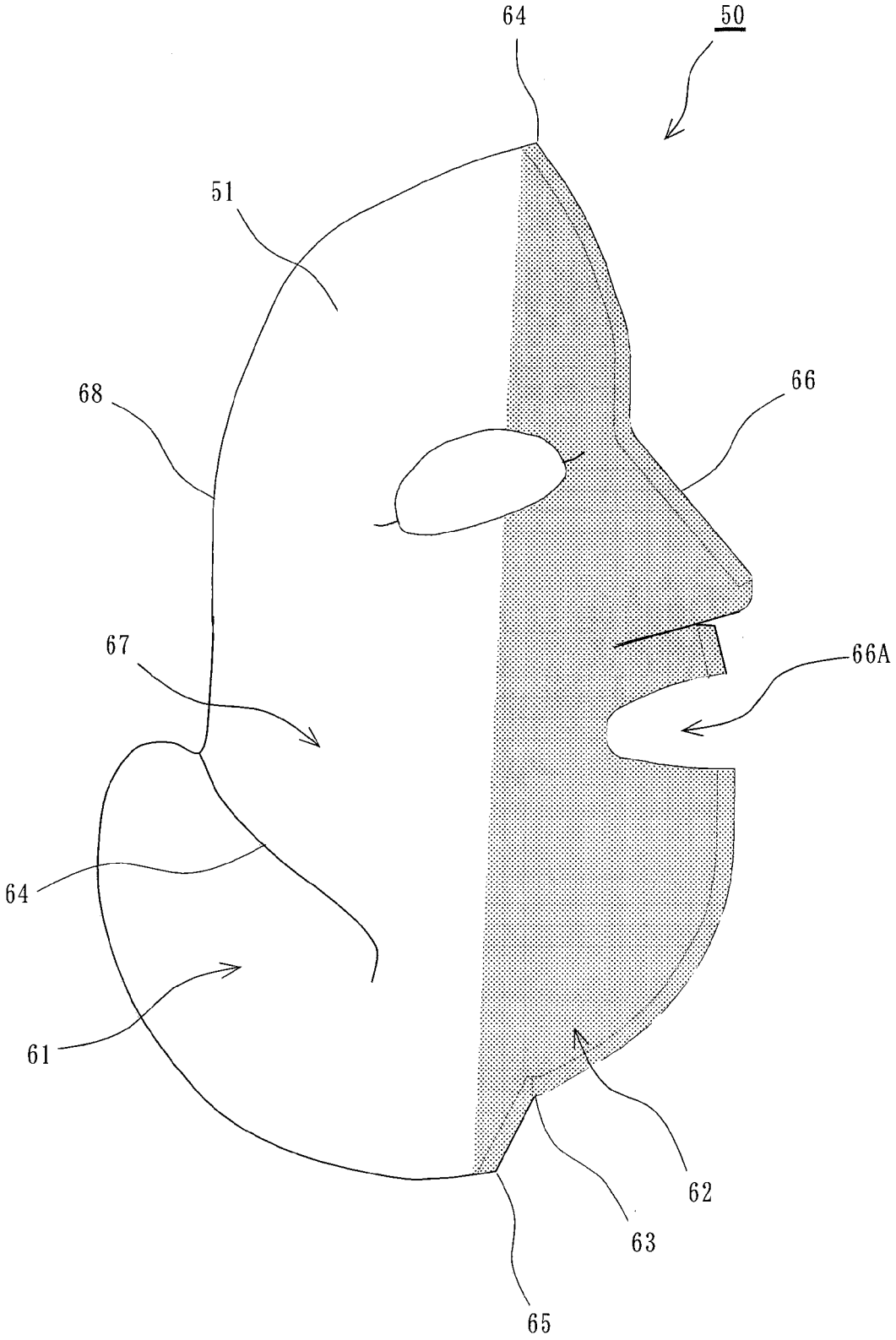
FIG. 9 is a plan view of a three dimensional face mask according to a fourth embodiment of the present invention.

As shown in FIG. 9, in a three dimensional face mask 50 according to a fourth embodiment of the present invention, on the right side sheet 51 and the left side sheet 52 (the left side sheet 52 is not visible in FIG. 9), along with a protrusion 65 being formed which protrudes downwards from the lower end portion 63 of a chin portion 62 which, during use, faces the chin of the user, also, from the lower portion of a rear edge portion 68 which is located on the opposite side of the mask from the front edge portion 66, there are formed an upwardly extended portion 61 which protrudes toward the exterior, and a notch 64 which extends from the rear edge portion 68 towards the front edge portion 66, between the upwardly extended portion 61 and a cheek portion 67 which, during use, faces the cheek of the user. And the other aspects of the structure of this fourth embodiment are the same as in the case of the three dimensional face mask 10 of the first embodiment, described above.

The front edge portion 66 of the right side sheet 51 exhibits a shape which, as a whole, is concave to the exterior and is made up from a plurality of circular arcs. As shown by the broken line in FIG. 9, this front edge portion 66 extends at a certain width from the upper point 64 of the mask 50 to its lower point 65, and thereby joins the right side sheet 51 to the left side sheet 52, except for the portion which, during use, opposes the lower surface of the user's nose, and the concave portion 66A which opposes the user's mouth.

Figure 10:
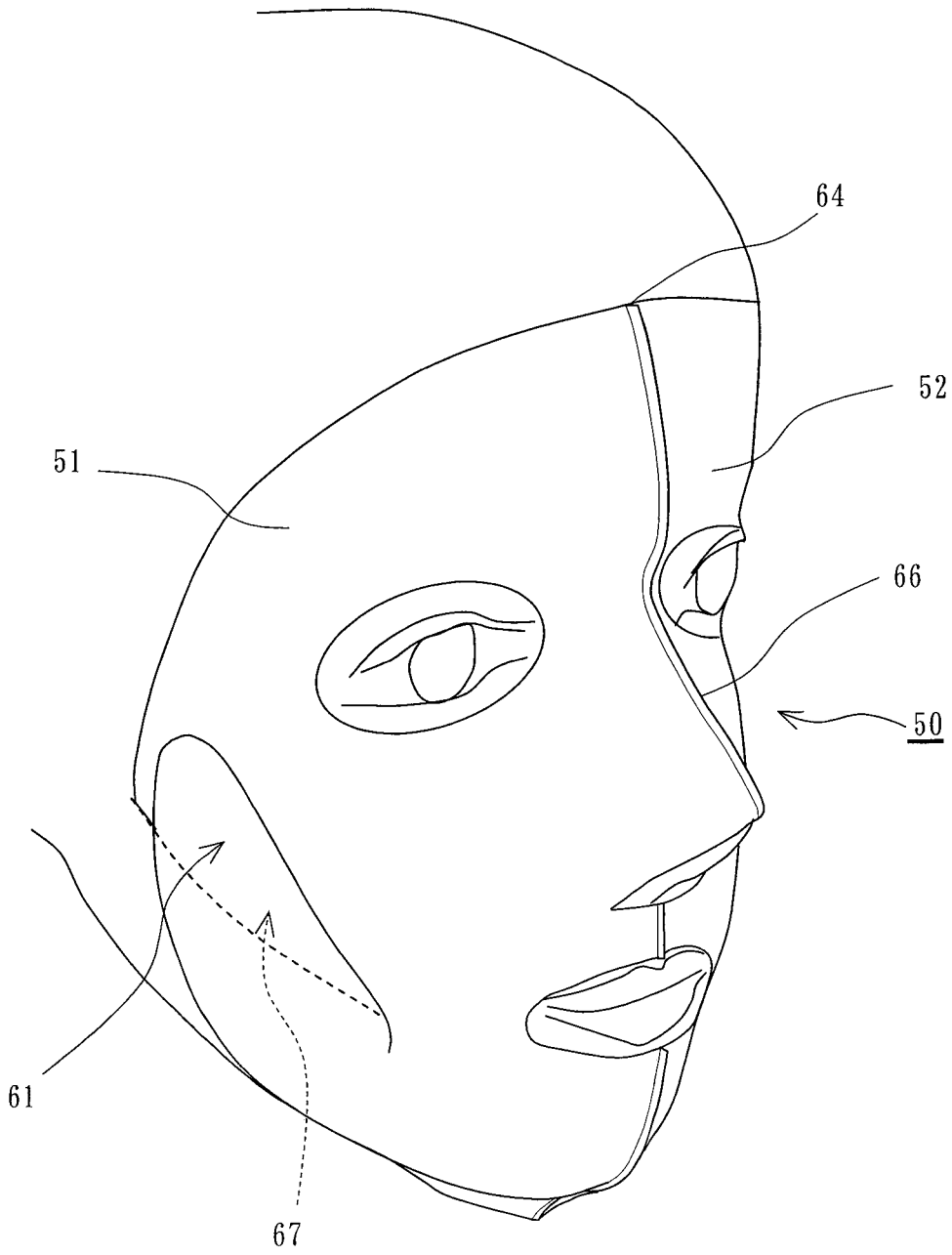
FIG. 10 is a figure showing the state of this three dimensional face mask according to the fourth embodiment of the present invention during use.

The front edge portions 66 of the right side sheet 51 and the left side sheet 52 are mutually adhered together down to the lower point 65 which projects downwards. When this three dimensional face mask 50 is adhered to the face of a user, as shown in FIG. 10, the upwardly extended portion 61 is further pulled upwards, and is adhered to the surface of the cheek portion 67. Due to this, it is possible to anticipate the advantageous effect that the user's skin from her chin to her cheek will be pulled upwards and lifted up.

All of the embodiments described above are only given by way of example, and the present invention is not to be considered as being limited thereto; as a matter of course, various modifications, additions, and omissions may be made to the details of any particular embodiment, within the range specified by the following Claims.

What is claimed is:

1. A three dimensional face mask formed as a sheet, which is to be mounted over the entire surface of the face of a user and impregnated with a liquid, comprising a planar left side sheet and a planar right side sheet which respectively, during use, oppose the left side and the right side of the face of the user, and which have front edge portions along a front edge of the mask, the front edge portions are mutually enantiomorphic and which, during use, oppose the median line of the face of the user, wherein:

said front edge portions present shapes which, overall, are convex to the outside;

said front edge portions each have:

a portion opposing a mid-eyebrow of the face that is made as a circular arc which is convex to the inside, a wedge-shaped cutaway formed at a portion of the front edge under a lower part of a nose in the face and opposed a point between the nose and upper lip of the user during use, and a cut joining with the wedge-shaped cutaway and extending in right and left directions in a plan view so as to supply an opening that opposes the respective nostril of the user during use; and said left side sheet and said right side sheet are provided with a thermoplastic adhesive material at least on certain inner surface portions thereof, in the thickness direction, of at least portions thereof which include areas towards their said front edge portions from lines which connect from their upper points to chin portions which, during use, oppose the chin of the user;

said front edge portions thereof are adhered together with the thermoplastic adhesive material by selectively applying heat over a strip of a certain width along the front edge except for a portion which, during use, opposes the nostrils of the user, and a portion which, during use, opposes the mouth of the user; and wherein the width of the heat-adhered strip of thermoplastic material is smaller than a width of the thermoplastic adhesive material.

2. A three dimensional face mask formed as a sheet, which is to be mounted over the entire surface of the face of a user and impregnated with a liquid, comprising a planar left side sheet and a planar right side sheet which respectively, during use, oppose the left side and the right side of the face of the user, and which have front edge portions along a front edge of the mask, the front edge portions are mutually enantiomorphic and which, during use, oppose the median line of the face of the user, wherein:

said front edge portions present shapes which, overall, are convex to the outside;

said front edge portions each have:

a portion opposing a mid-eyebrow of the face that is made as a circular arc which is convex to the inside, a wedge-shaped cutaway formed at a portion of the front edge under a lower part of a nose in the face and opposed a point between the nose and upper lip of the user during use, and a cut joining with the wedge-shaped cutaway and extending in right and left directions in a plan view so as to supply an opening that opposes the respective nostril of the user during use; and said left side sheet and said right side sheet are provided with a thermoplastic adhesive material at least on certain inner surface portions thereof, in the thickness direction, of at least portions thereof which include areas towards their said front edge portions from lines which connect from their upper points to chin portions which, during use, oppose the chin of the user;

said front edge portions thereof are adhered together with the thermoplastic adhesive material by selectively applying heat over a strip of a certain width along the front edge except for a portion which, during use, opposes the nostrils of the user, and a portion which, during use, opposes the mouth of the user; and wherein the cut that supplies the opening that opposes the respective nostril of the user during use has an upwardly curved turn at an end of the cut distal the front edge.

* * * * *